US009611072B2

(12) United States Patent
Sharon et al.

(10) Patent No.: US 9,611,072 B2
(45) Date of Patent: Apr. 4, 2017

(54) MODULAR INTERCONNECTING KNOCKDOWN CONTAINER SYSTEM

(71) Applicants: Arie Nissan Sharon, Garland, TX (US); Michael Sharon, Kfar-Sabba (IL)

(72) Inventors: Arie Nissan Sharon, Garland, TX (US); Michael Sharon, Kfar-Sabba (IL)

( * ) Notice: Subject to any disclaimer, the term of this patent is extended or adjusted under 35 U.S.C. 154(b) by 0 days.

(21) Appl. No.: 14/983,721

(22) Filed: Dec. 30, 2015

(65) Prior Publication Data

US 2016/0194111 A1 Jul. 7, 2016

Related U.S. Application Data

(60) Provisional application No. 62/124,778, filed on Jan. 2, 2015.

(51) Int. Cl.
*B65D 21/02* (2006.01)
*B65D 5/468* (2006.01)
*B65D 5/02* (2006.01)

(52) U.S. Cl.
CPC ..... *B65D 21/0204* (2013.01); *B65D 5/0254* (2013.01); *B65D 21/0212* (2013.01)

(58) Field of Classification Search
CPC .... B65D 21/0204; B65D 5/02; B65D 5/4608; B65D 5/5495; B65D 5/427
USPC ..... 229/108, 120.011; 206/822; 220/23.4
See application file for complete search history.

(56) References Cited

U.S. PATENT DOCUMENTS 3,287,075 A * 11/1966 Batke ..... B65D 5/38 206/504

FOREIGN PATENT DOCUMENTS

FR EP 0608652 A1 * 8/1994 ..... B42F 7/14

* cited by examiner

*Primary Examiner* — Christopher Demeree
(74) *Attorney, Agent, or Firm* — Blynn L. Shideler; Krisanne Shideler; BLK Law Group

(57) ABSTRACT

A modular interconnecting knockdown container system includes a plurality of individual containers selectively coupled together to form a free standing unit. Each container is a knockdown container formed from a single substrate assembled into the container having a plurality of side members and extending between opposed ends of the container. Each container includes a plurality of coupling tabs adjacent each container end on at least two of the sides, wherein each tab may selectively extend beyond the adjacent container end. Each container includes a plurality of coupling tab receiving slots adjacent each container end on at least two sides at each container end and aligned with the coupling tabs adjacent the container end, wherein each tab receiving slot may selectively receive a tab of an adjacent container. Adjacent containers have the coupling tabs adjacent one end received within the tab receiving slots of an adjacent end of an adjacent container.

18 Claims, 5 Drawing Sheets

10
20
22
24
26
30
40
50

FIG. 6
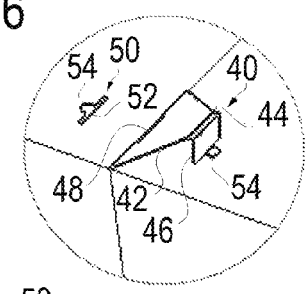
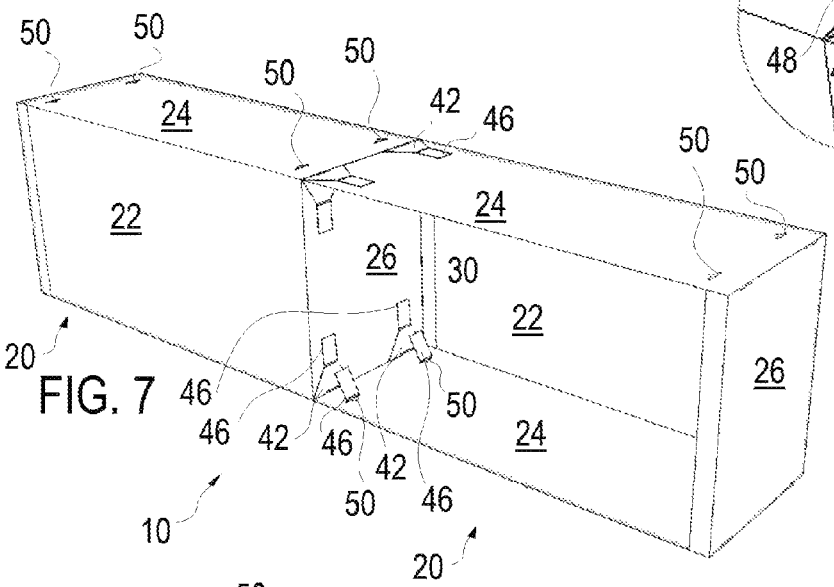
FIG. 7
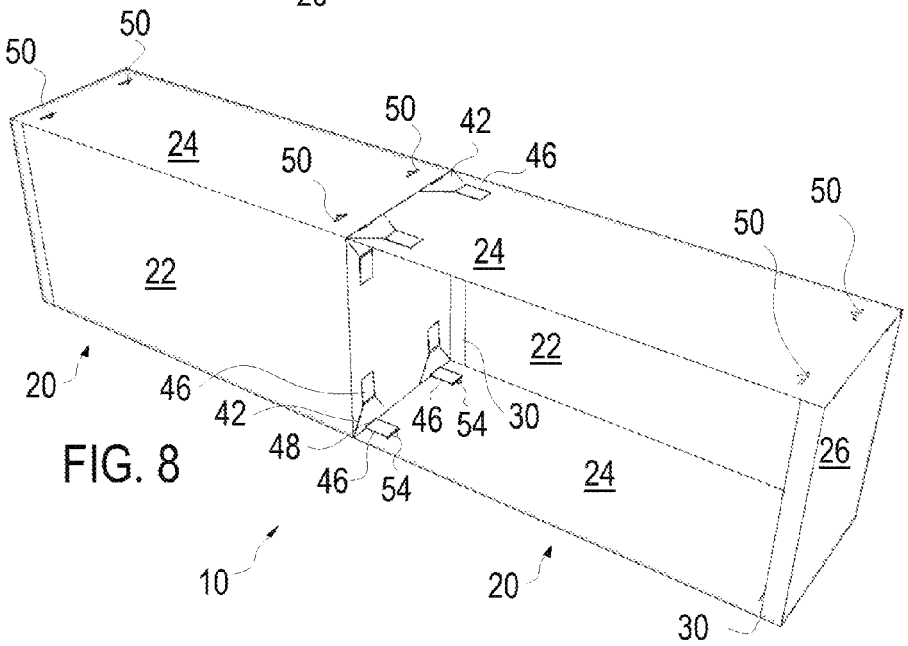
FIG. 8

FIG. 9
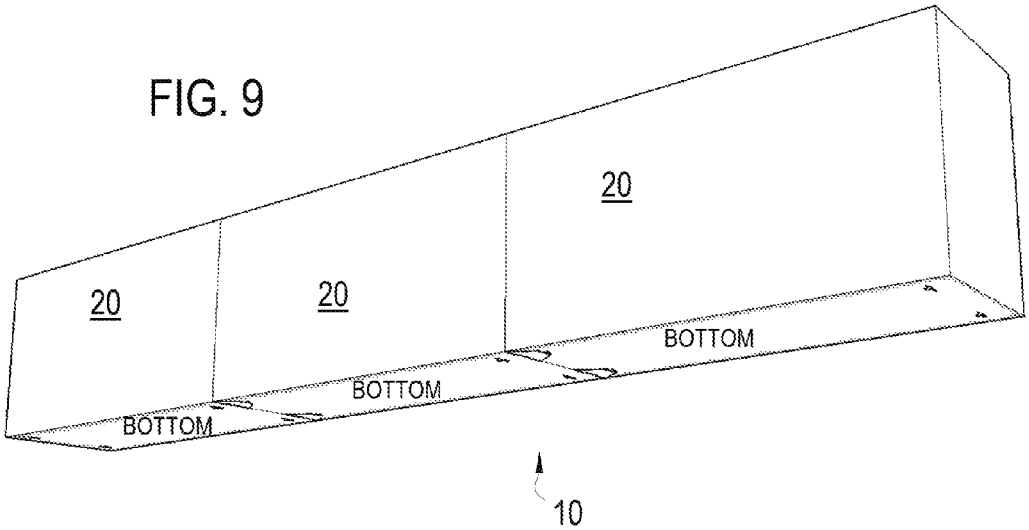
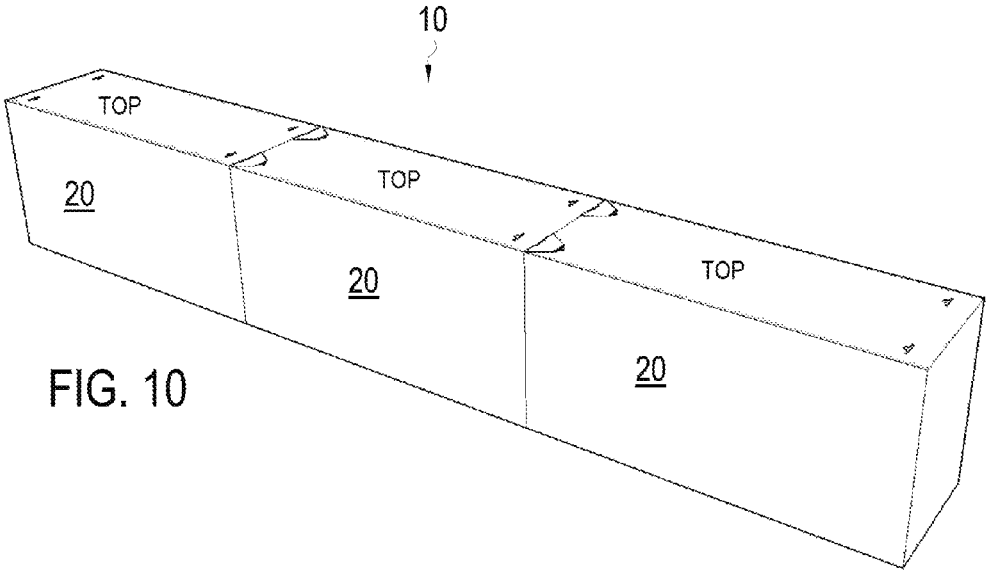
FIG. 10

MODULAR INTERCONNECTING KNOCKDOWN CONTAINER SYSTEM

RELATED APPLICATIONS

This application claims the benefit of U.S. Provisional Patent Application Ser. No. 62/124,778, filed Jan. 2, 2015 entitled "Connected (Bridged) Container/Boxes (to Each Other), Without Glue or any Hardware" which application is incorporated herein by reference in its entirety.

BACKGROUND INFORMATION

1. Field of the Invention

The present invention relates to a modular interconnecting knockdown container system wherein the individual boxes or containers may be combined into an integrated free standing structure without the use of glue or hardware.

2. Background of the Invention

The term box (plural boxes) describes an infinite variety of containers and receptacles for permanent use as storage, or for temporary use often for transporting contents. The terms box and container are used interchangeably throughout this disclosure. Boxes may be made of durable materials such as wood or metal, or of corrugated fiberboard, paperboard, or other non-durable materials. The size may vary from very small (e.g., a matchbox) to the size of a large appliance. A corrugated box is a very common shipping container. When no specific shape is described, a box of rectangular cross-section with all sides flat may be expected, but a box may have a horizontal cross section that is square, elongated, round or oval; sloped or domed top surfaces, or non-vertical sides.

"Cardboard boxes" are industrially prefabricated boxes, primarily used for packaging goods and materials, although those in industry seldom use the term cardboard alone because it does not denote a specific material. The term cardboard may refer to a variety of heavy paper-like materials, including card stock, corrugated fiberboard or paperboard, and herein the term cardboard will reference all of these materials unless otherwise specified. The first commercial paperboard (not corrugated) box was produced in England in 1817 and cardboard box packaging was made the same year in Germany. Robert Gair invented the pre-cut knockdown cardboard or paperboard box in 1890, namely flat pieces manufactured in bulk that folded into boxes. The advent of flaked cereals increased the use of cardboard boxes and the first to use cardboard boxes as cereal cartons was the Kellogg Company. Corrugated (also called pleated) paper was patented in England in 1856, and used as a liner for tall hats, but corrugated boxboard was not patented and used as a shipping material until 20 Dec. 1871. The first corrugated cardboard box manufactured in the USA was in 1895 and by the early 1900s, wooden crates and boxes were being replaced by corrugated paper shipping cartons.

Today Packaging engineers design corrugated boxes to meet the particular needs of the product being shipped, the hazards of the shipping environment, (shock, vibration, compression, moisture, etc.), and the needs of retailers and consumers. The term knockdown within this application references boxes assembled from a single flat substrate. Some knockdown boxes are formed with an open top and are associated with a separate knockdown lid. The typical knockdown lid is often constructed as a matching box with an open top and very shallow sides, and in other contexts such lids are called trays that are used with shrink wrap for shipping a collection of items.

The most common die cut knockdown box style is the Regular Slotted Container (RSC). All flaps of the RSC are the same length from the score to the edge. Typically, the longer major flaps meet in the middle and the minor flaps do not. The manufacturer's joint of the RSC is where the sides of the RSC are connected together and is most often formed with adhesive but may also be taped or stitched. The box is shipped flat (knocked down) to the user, such as a packager who sets up the box, fills it, and closes it for shipment. Box closure may be by tape, adhesive, staples, strapping, etc. The size of a box can be measured for either internal (for product fit) or external (for handling machinery or palletizing) dimensions. Boxes are usually specified and ordered by the internal dimensions.

A seal may be printed on an outside surface, typically the bottom of the box, and the seal, if provided, includes some information about the box's strength characteristics. This is also known as the Box Maker's Certificate or Box Certificate. The certificate is not required, but it if is used that implies compliance with regulations relating to the certificate. Significant information includes: 1) Bursting Test or Edge Crush Test; 2) Size Limit (the maximum outside dimensions of a finished box when the length, width and depth of the box are added together); 3) Gross Weight Limit.

Corrugated Boxes can be formed in the same plant as the corrugator (the unit forming the corrugated board, and such plants are known as "integrated plants". Part of the scoring and cutting takes place in-line on the corrugator. Alternatively, sheets of corrugated board may be sent to a different manufacturing facility for box fabrication; these are sometimes called "sheet plants". The corrugated board is creased or scored to provide controlled bending of the board. Most often, slots are cut to provide flaps on the box, and often such scoring and slotting can also be accomplished by die-cutting. Graphic print for informative and marketing purposes is often applied to a surface of the corrugated box material.

Boxes, such as corrugated boxes, can be integrated into a single structure, such as for a self-standing retail display. There remains a need in the art to provide a simple method of coupling boxes such as corrugated boxes into a single integrated free standing structure.

SUMMARY OF THE INVENTION

One aspect of the present invention provides a modular interconnecting knockdown container system includes a plurality of individual containers which are configured to be selectively coupled together to form a free standing unit. Each container is a knockdown container formed from a single die-cut substrate assembled into the container having a plurality of planar sides formed by a plurality of side members and extending between opposed ends of the container. Each container includes a plurality of coupling tabs adjacent each end of the container and provided on at least two of the sides at each end of the container, wherein each tab is configured to selectively extend beyond the adjacent end of the assembled container. Each container includes a plurality of coupling tab receiving slots adjacent each end of the container and provided on at least two of the sides at each end of the container and aligned with the coupling tabs adjacent the end of the container, wherein each tab receiving slot is configured to selectively receive a tab of an adjacent container. Adjacent containers have the plurality of coupling tabs adjacent one end of one container received within the tab receiving slots of an adjacent end of an adjacent container.

The modular interconnecting knockdown container system according to the present invention may provide that each individual container includes end members configured to selectively form closed ends of the container. The coupling tabs of each container may be configured to be folded within the container and not extend beyond the end of the container when not utilized to couple the container to an adjacent container. The sides of each container may be planar forming a polygonal container shape in cross section, such as a rectangle. Each container may include a plurality of coupling tabs on each of at least two of the sides at each end of the container. Each coupling tab which is received within the tab receiving slots of an adjacent end of an adjacent container may be folded within the adjacent container to extend toward the container. Each tab receiving slot may further include an access opening configured to receive a tab folding member, such as the user's finger, therein during assembly. Each tab may include a tab locking slot therein which is configured to receive the tab of an adjacent container therein. The modular interconnecting knockdown container system according to the present invention may be provided wherein each container is formed of die-cut corrugated cardboard.

Another aspect of the present invention is an individual container of a modular interconnecting knockdown container system, wherein the individual container comprises a knockdown container formed from a single die-cut substrate assembled into the container having a plurality of planar sides formed by a plurality of side members and extending between opposed ends of the container; wherein each container includes a plurality of coupling tabs adjacent each end of the container and provided on at least two of the sides at each end of the container, wherein each tab is configured to selectively extend beyond the adjacent end of the assembled container; and wherein each container includes a plurality of coupling tab receiving slots adjacent each end of the container and provided on at least two of the sides at each end of the container and aligned with the coupling tabs adjacent the end of the container, wherein each tab receiving slot is configured to selectively receive a tab of an adjacent container.

These and other advantages of the present invention will be clarified in the brief description of the preferred embodiment taken together with the drawings in which like reference numerals represent like elements throughout.

BRIEF DESCRIPTION OF THE DRAWINGS

FIG. 6 is an enlarged schematic perspective view of the connecting process of assembled individual containers of the modular interconnecting knockdown container system according to one embodiment of the present invention;

FIG. 7 is a schematic perspective view of the connecting process of assembled individual containers of the modular interconnecting knockdown container system according to one embodiment of the present invention, wherein one side of one assembled individual container is removed for clarity;

FIG. 8 is a schematic perspective view of the connecting process of assembled individual containers of the modular interconnecting knockdown container system according to one embodiment of the present invention, wherein one side of one assembled individual container is removed for clarity;

FIG. 9 is a schematic bottom perspective view of assembled individual containers of the modular interconnecting knockdown container system according to one embodiment of the present invention;

FIG. 10 is a schematic top perspective view of assembled individual containers of FIG. 9.

DESCRIPTION OF THE PREFERRED EMBODIMENTS

Figure 1:
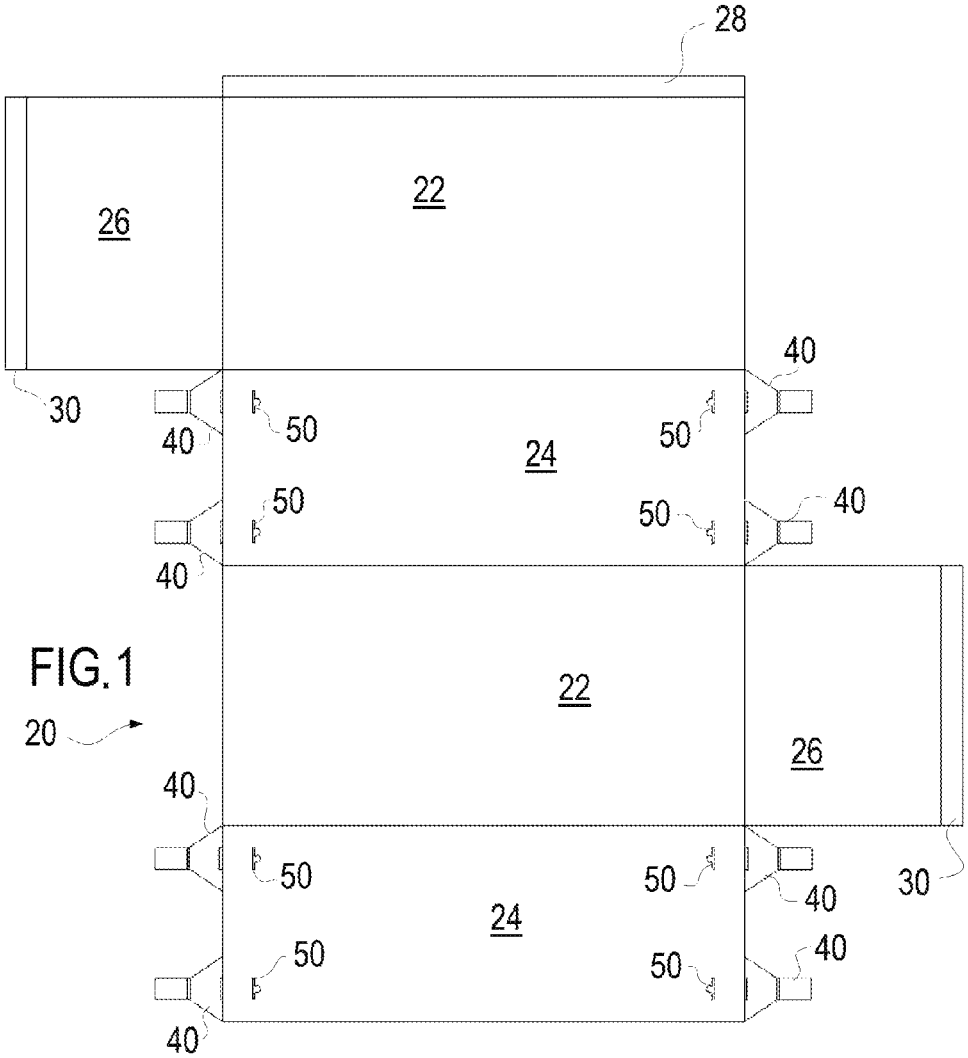
FIG. 1 is a schematic plan view of a knocked down individual container of a modular interconnecting knockdown container system according to one embodiment of the present invention.
Figure 2:
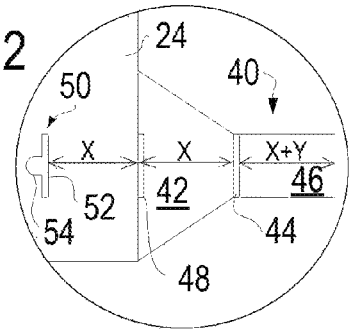
FIG. 2 is an enlarged plan view of a connecting tab and tap receiving slot for the individual container of FIG. 1.

As illustrated in FIGS. 1-10, the present invention provides a modular interconnecting knockdown container system 10 includes a plurality of individual containers 20 which are configured to be selectively coupled together to form a free standing unit. FIGS. 9 and 10 are schematic bottom and top perspective views, respectively, of assembled individual containers 20 of the modular interconnecting knockdown container system 10 according to one embodiment of the present invention. A principle concept of the present invention is to provide knockdown containers, such as die cut corrugated cardboard boxes, with tabs 40 and slots 50 as part of their design, that can connect to each other, or "bridged together" to create one free standing integrated solid structure (system 10), the "bridge", without the need of any other inter-box connecting methods, such a glue, tape, pins, screws, staples, or the like.

The individual containers 20, or boxes, are preferably made from cardboard or corrugated cardboard, but also can be from other materials, such as plastic sheet, corrugated plastic sheets, or the like.

The individual containers 20 that are shown in the drawings are rectangular in cross section, but this principal of tabs 40 and slots 50 can be designed or adapted to any other geometric shape containers 20. Thus each container 20 shown can be described as a knockdown container 20 formed from a single substrate assembled into the container 20 having a plurality of planar sides formed by a plurality of side members 22 and 24. The side members 22 and 24 extend between opposed ends of the container 20 with end members 26 coupled to side members 22. An adhesive area or strip 28 is coupled to one side member 22 for forming the manufacturer's joint, and in a similar manner the end members 26 may include an adhesive area or strip 30. The die cutting and scoring of fold lines between members 22, 24, 26, 28 and 30, and the associated adhesives used for forming these conventional aspects of the container 20 are well known to those of ordinary skill in the art. Additional changes include replacing the strips 28 and 30 with non-adhesive couplings, or peel off strips for the adhesive as known in the art.

Further the side members 22 and 24 may include additional openings or other features associated with a desired purpose for the assembled system 10, analogous to the extended size of slot 50 in embodiment of FIGS. 11A-C discussed below. These are not shown here for clarity and they do not form part of the inventive aspects of the invention. For example, however, in a point of sale retail display one or more side members 22 or 24 may include a series of holes supporting individual products to be displayed on the assembled system. Alternatively, hinged door may be formed in one or more side members 22 or 24 to allow easy access to the interior of each container 20 after the system 10 is assembled. As a further example, in a point of sale retail display a large opening may be formed in one side members 22 or 24 to allow products to be displayed and accessed within the interior of each container 20 after the system 10 is assembled. The system 10 of the present invention is intended to provide a unified platform for, among other purposes, designing and building point of sale retail custom floor displays, point of sale retail custom counter displays, point of sale retail custom endcap displays, point of sale retail custom power wing (also called sidekick) displays, and point of sale retail custom inline displays to name a few. Another advantage of the system 10 of the present invention applied to retail point of sale displays is that the system 10 will allow the retailers to utilize the same boxes 20 to selectively form a counter display or an endcap display by merely selecting the desired number of boxes in the display (and it will be appreciated that some boxes 20 in some retail point of sale displays may not utilize product display features incorporated therein and may be used merely as spacing or supporting blocks in the display). The application of the system 10 of the present invention is also not limited to retail point of sale displays, but can be as wide spread as the uses of boxes.

Each container 20 of the system 10 of the present invention includes a plurality of coupling tabs 40 adjacent each end of the container and provided on at least two of the side members 24 at each end of the container 10. Specifically each of opposed side members 24 is provided with a pair of coupling tabs 40, wherein each tab 40 is configured to selectively extend beyond the adjacent end (and end member 26) of the assembled container 20. In the embodiment shown, each coupling tab 44 has a fold line at the coupling to the side member 24 and includes a first trapezoidal shaped extension 42 extending a given distance X, equating to a slot distance discussed below. Each coupling tab 40 includes a short extension 44 coupled to the end of the first extension 42 with a fold line there between with the short extension 44 extending for a length Y substantially equal to the thickness of the substrate forming the container 20. Finally adjacent the short extension 44, and separated by another fold line, is the locking extension 46 that extends generally for the length of X+Y. Further the coupling tab 40 includes a tab locking slot 48 therein which is configured to receive the tab's locking extension 46 of an adjacent container 20 therein as discussed below. The length of locking extension 46, is slightly longer (X+Y) than the length of the first extension 42 such that the top part of extension 46 can penetrate into locking slot 48 of an associated tab 40 of an adjacent container 20, when the containers 20 are connected to each other.

Each container 20 includes a plurality of coupling tab receiving slots 50 adjacent each end of the container 20 and provided on the sides 24 at each end of the container 20 to be aligned with the coupling tabs 40 adjacent the end of the container. Each tab receiving slot 50 includes a rectangular slot 52 and an access opening 54 configured to receive a tab folding member, such as the user's finger, therein during assembly. Each tab receiving slot 50 is spaced from the end of the container 20 the same distance as the length of the first extension 42 and is configured to selectively receive a tab 40 of an adjacent container 20. The width of slots 48 and 52 are generally equal to the widths of the extensions 44 and 46 while the depth of the slots 48 and 52 generally correspond to the thickness of the substrate forming the container 20.

As described below, adjacent containers 20 of the system 10 of the invention have the plurality of coupling tabs 40 adjacent one end of one container 20 received within the tab receiving slots 50 of an adjacent end of an adjacent container 20. The assembly will be discussed in connection with FIGS. 3-8.

Figures 3, 4, 5:
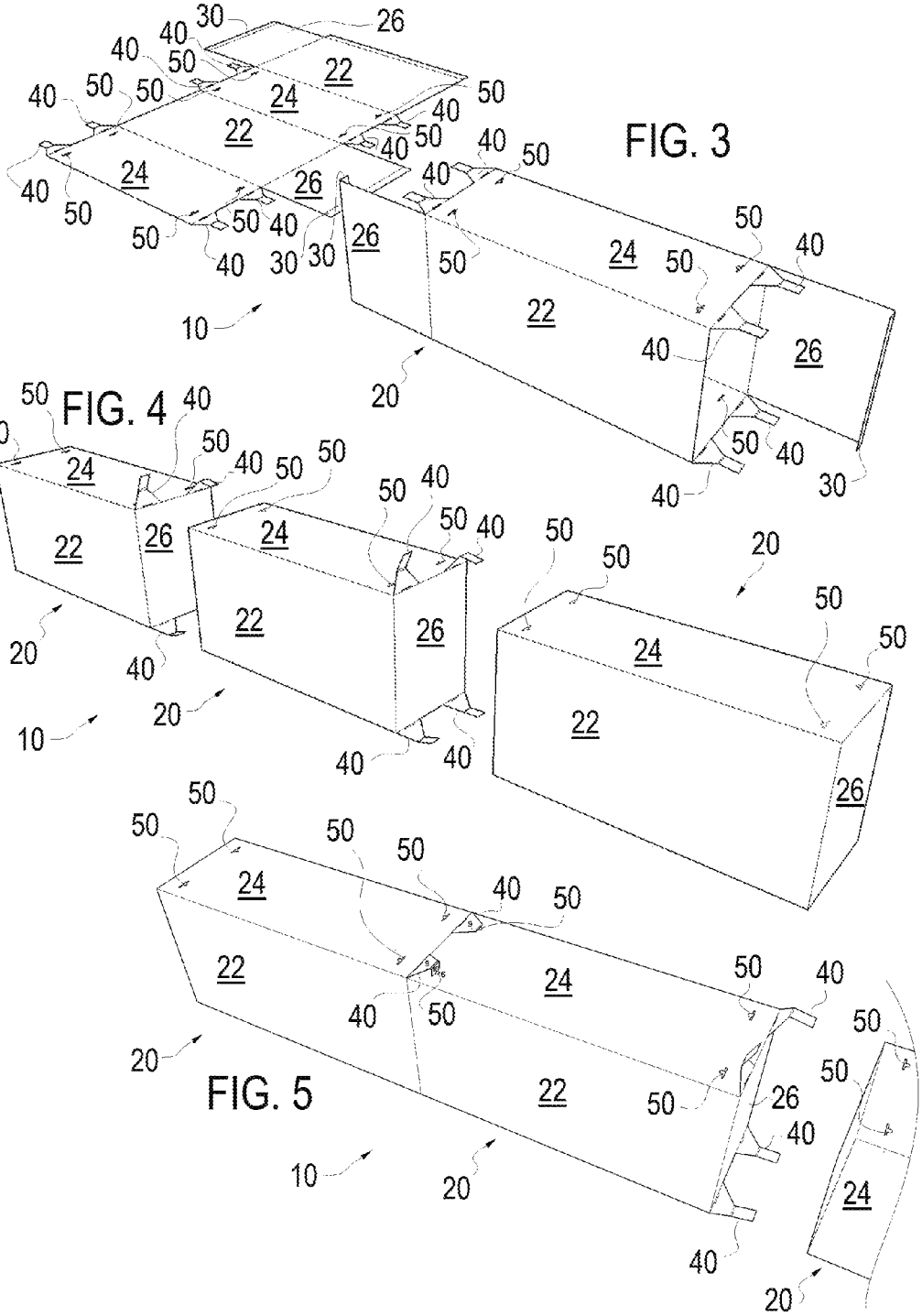
FIG. 3 is a schematic perspective view of an unassembled individual container and a partially assembled individual container of the modular interconnecting knockdown container system according to one embodiment of the present invention.
FIG. 4 is a schematic perspective view of unconnected assembled individual containers of the modular interconnecting knockdown container system according to one embodiment of the present invention.
FIG. 5 is a schematic perspective view of the connecting process of assembled individual containers of the modular interconnecting knockdown container system according to one embodiment of the present invention.

In FIG. 3 the first container 20 is in the fully knocked down or flat position, while the second container 20 has the sides 22 and 24 in position with the adhesive area or strip 28 which is coupled to one side member 22 being glued to an adjacent side member 24 forming the manufacturer's joint. The end members 26 of the container 20 are not folded in, and the container 20 is still open on these sides in this step.

FIG. 4 shows the closing of the end members 26 of each of the containers 20 forming the free standing structure of the system 10. As shown here, the coupling tabs 40 which are not going to extend through the coupling tab receiving slots 50 of an adjacent container 20 are folded within the container 20 and do not extend beyond the end of the container 20. The interior folded tabs 40 include those at the extreme ends of the system 10 which are not utilized to couple those end containers 20 to an adjacent container. Further, one side of coupling tabs 40 at adjacent containers 20 is also folded within the container 20 as shown, and the locking slot 48 of these inwardly folded tabs will held lock the coupling tabs 20 of adjacent containers 20 in place.

As shown in FIGS. 5-6, the adjacent boxes 20 are pushed together at their end members 26 and the locking extension 46 are inserted into slots 52 of the adjacent container 20. The locking extension 46 of tabs 40 which are inserted through the slots 52 should be tacked (pushed) down all the way, till until locking extension 46 is flat against side member 24 as shown in the tabs 40 on the bottom of FIGS. 7 and 8. With the help of a finger, or other tool, through the access opening 54 on slot 50, the locking extension 46 of tabs 40 which are inserted through the slots 52 are push toward locking slots 48 of associated tabs 40 on the inside of the container 20. The top end of the locking extension will thus get snapped into locking slots 48 and cannot swing back out on their own from slots 48. This process gets repeated on the other side of the container 20, so all four tabs 40 of container 20 are inside slots 50 of adjacent container 20, and they all are locked by locking slots 48. In this simple manner one container/box 20 become connected as one part with an adjacent container/box 20, and cannot be separated till its tabs 40 are out of the adjacent container/box 20.

The containers 20 can have more, or less, than two tabs 40 and slots 50 on each opposed side 24. Alternatively, they can also have the tabs 40 and slots 50 on one side only. They can also have tabs 40 and slots 50 on more than two sides of the containers 20. The slots 50 and associated tabs 40 can be in different sizes (longer, shorter, wider, narrower) than as shown in the drawings, in order to make the container connections work in the best way to reach this connecting or bridging principle.

Additionally it may be desired to have the end members 26 folded down within the containers 20 of adjacent containers to form a continuous open interior throughout the coupled containers. In this case the desired end members 26 may be folded flat against a side member 22, and held in position with strip 30. This option is described to show the added versatility of the system 10.

Figure 11B:
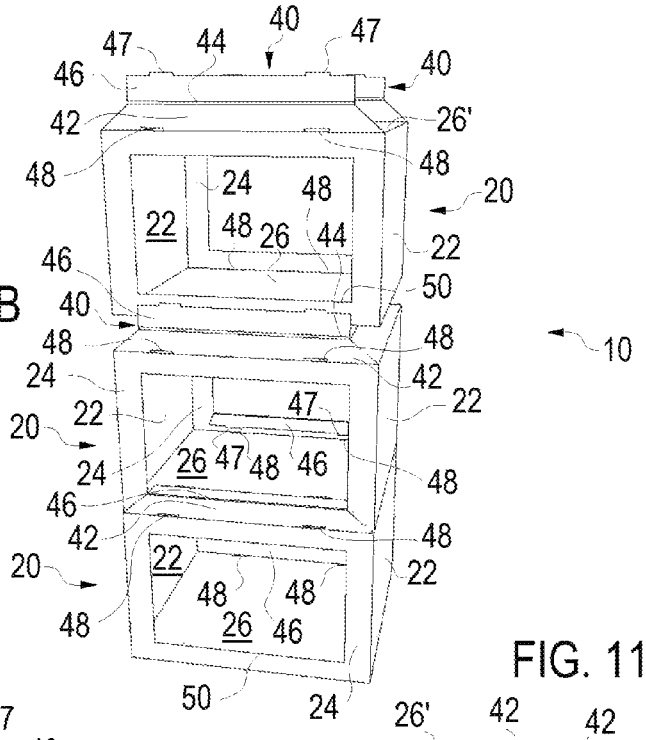
FIGS. 11A-C are schematic perspective views of the connecting process of assembled individual containers of the modular interconnecting knockdown container system according to another embodiment of the present invention.
Figure 11A:
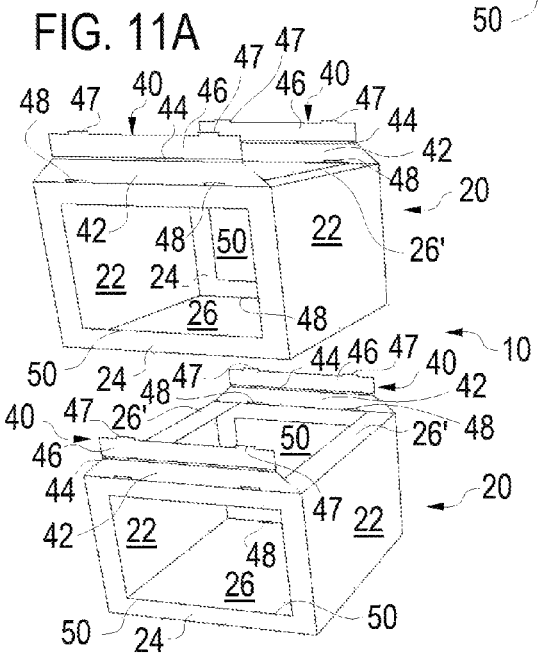
Figure 11C:
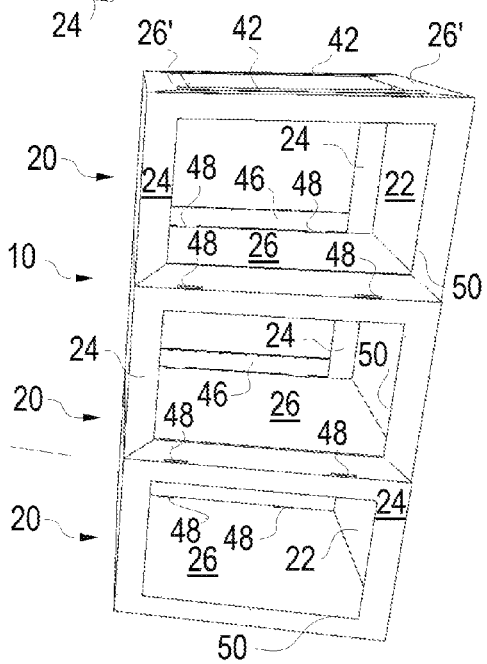

FIGS. 11A-C are schematic perspective views of the connecting process of assembled individual containers 20 of the modular interconnecting knockdown container system 10 according to another embodiment of the present invention useful for tower type retail store displays. The individual containers 20 that are shown in the drawings are again rectangular in cross section, but this version is designed for a column or tower type system 10 and the tabs 40 and slots 50 are designed for one-way attachment from the lower to an upper container 20. Each container 20 shown can also be described as a knockdown container 20 formed from a single substrate assembled into the container 20 having a plurality of planar sides formed by a plurality of side members 22 and 24. The side members 22 and 24 extend between opposed ends of the container 20 with a lower end member 26 coupled to side members 22 as described above. On the upper side a pair of end member portions 26' are coupled to the side members 22.

In the embodiment of FIGS. 11A-C each side member 24 includes a single coupling tab 40 and each tab 40 is configured to selectively extend beyond the adjacent end, and the pair of end member portions 26' of the assembled container 20. In the embodiment shown, each coupling tab 44 has a fold line at the coupling to the side member 24 and includes a first trapezoidal shaped extension 42 extending a given distance X, equating to a slot distance of slot 50. Each coupling tab 40 includes a short extension 44 coupled to the end of the first extension 42 with a fold line there between with the short extension 44 extending for a length Y substantially equal to the thickness of the substrate forming the container 20. Finally adjacent the short extension 44, and separated by another fold line, is the locking extension 46 that extends generally for the length of X+Y. The locking extension 46 includes two locking nubs 47 as part thereof. Further the coupling tab 40 includes a pair of tab locking slots 48 therein which is configured to receive the nubs 47 of the locking extension 46 when not coupling the container 20 to an adjacent container (i.e. the uppermost container 20). Each container 20 includes a plurality of coupling tab receiving slots 50 provided on the sides 24 at each end of the container 20 spaced from the end of the container 20 the same distance as the length of the first extension 42 and is configured to selectively receive a tab 40 of an adjacent lower container 20. The width of slots 48 are generally equal to the widths of the nubs 47 of extension 46 while the depth of the slots 48 generally correspond to the thickness of the substrate forming the container 20. The width of slots 50 are generally equal to the widths of the of extension 44 and 46, however the depth of slot 50 is greatly increases as the slot 50 is intended to also allow access into the container 20 in the tower display. Additionally the end member 26 included locking slots 48 for locking the coupling tab 40 of a lower container 10.

In operation the containers are formed in a conventional fashion and they are begun to be stacked as shown in FIG. 11A. The tabs 40 of the lower container 20 are fed through the respective slots 50 (or openings) of the upper container 20. The size of the opening or slot 50 makes this a simple matter. The extension 46 is folded over as shown in FIG. 11B and pushed down until the nubs 47 engage and lock within the locking slots 48 in the end member 26 that are adjacent the side member 24 in the final position in FIG. 11C to secure the two adjacent containers together. The tabs 40 of the uppermost container 20 are folded such that the extension 42 rests upon the end member portions 26' and the extensions 46 are folded through the space between the portions 26' to fold against the extension 42 till the nubs 47 engage in the locking slots 48 of the extension 42. The upper end is thus formed and reinforced by the coupling tabs 40 of the uppermost container 20. The uppermost container will also have an open top architecture for the benefit of the retail display unit. FIGS. 11A-C are intended to illustrate the versatility of the platform of the system 10 of the present invention.

Although the present invention has been described with particularity herein, the scope of the present invention is not limited to the specific embodiments disclosed. It will be apparent to those of ordinary skill in the art that various modifications may be made to the present invention without departing from the spirit and scope thereof.

What is claimed is:

1. A modular interconnecting knockdown container system comprising:

a free standing structure formed of a plurality of individual containers which are coupled together;

wherein each container is a knockdown container formed from a single flat substrate assembled into the container having a plurality of sides formed by a plurality of planar side members and extending between opposed planar ends of the container;

wherein each container includes a plurality of coupling tabs adjacent at least one end of the container and provided on at least two of the sides at each end of the container, wherein each tab is configured to selectively extend beyond at least one end of the container, wherein each coupling tab is attached to and extends from one planar side member, and wherein each coupling tab includes a first fold line between the coupling tab and the side member from which it extends, and includes a first extension extending from the first fold line, and includes a second fold line at an opposed side of the first extension from the first fold line, and includes a second extension extending from the second fold line;

wherein each container includes a plurality of coupling tab receiving slots adjacent at least one end of the container and provided on at least two of the sides on at least one end of the container and aligned with at least one coupling tab, wherein each tab receiving slot is configured to selectively receive a coupling tab of an adjacent container; and wherein adjacent containers have a plurality of coupling tabs of one container received within the tab receiving slots of an adjacent container, wherein each coupling tab is configured to be received within a tab receiving slot of an adjacent container and is configured to be folded about the second fold line, and further including a tab locking slot configured to receive one coupling tab whereby the first extension is adjacent an outside surface of the adjacent container and the second extension is adjacent an opposed interior surface of the adjacent container.

2. The modular interconnecting knockdown container system according to claim 1 wherein at least one planar end of each individual container is configured to selectively form a closed end of the container.

3. The modular interconnecting knockdown container system according to claim 2 wherein the coupling tabs are configured to be folded within the container and not extend beyond the end of the container when not utilized to couple the container to an adjacent container.

4. The modular interconnecting knockdown container system according to claim 3 wherein the sides of each container form a polygonal container shape in cross section.

5. The modular interconnecting knockdown container system according to claim 4 wherein each container is rectangular in cross section.

6. The modular interconnecting knockdown container system according to claim 5 wherein each container includes a plurality of coupling tabs on each of at least two of the sides at each end of the container.

7. The modular interconnecting knockdown container system according to claim 6 wherein each tab receiving slot includes an access opening configured to receive a tab folding member therein during assembly.

8. The modular interconnecting knockdown container system according to claim 7 wherein each tab includes one tab locking slot therein which is configured to receive the tab of an adjacent container therein.

9. The modular interconnecting knockdown container system according to claim 8 wherein each container is formed of die-cut corrugated cardboard.

10. A modular interconnecting knockdown container system comprising:

a plurality of individual containers which are configured to be selectively coupled together to form a free standing unit;

each container is a knockdown container formed from a single die-cut planar substrate assembled into the container having a plurality of planar sides formed by a plurality of planar ends and a plurality of side members extending between opposed ends of the container;

wherein each container includes a plurality of coupling tabs adjacent at least one end of the container and provided on at least two of the side members on at least one end of the container, wherein each tab is configured to selectively extend beyond at least one end of the assembled container, wherein each coupling tab is attached to and extends from one side member, and wherein each coupling tab includes a first fold line between the tab and the side member from which it extends, and includes a first extension extending from the first fold line, and includes a second fold line at an opposed side of the first extension from the first fold line, and includes a second extension extending from the second fold line;

wherein each container includes a plurality of coupling tab receiving slots adjacent at least one end of the container and provided on at least two of the side members on at least one end of the container and aligned with at least one coupling tab, wherein each tab receiving slot is configured to selectively receive a coupling tab of an adjacent container; and wherein adjacent containers have a plurality of coupling tabs of one container received within the tab receiving slots of an adjacent container, wherein each coupling tab is configured to be received within a tab receiving slot of an adjacent container and is configured to be folded about the second fold line, and further including a tab locking slot configured to receive one coupling tab whereby the first extension is adjacent an outside surface of the adjacent container and the second extension is adjacent an opposed interior surface of the adjacent container.

11. The modular interconnecting knockdown container system according to claim 10 wherein each tab receiving slot includes a finger access opening configured to receive a user's finger therein during assembly.

12. The modular interconnecting knockdown container system according to claim 11 wherein each tab includes one tab locking slot therein which is configured to receive the tab of an adjacent container therein.

13. The modular interconnecting knockdown container system according to claim 12 wherein each individual container includes planar ends configured to selectively form closed ends of the container.

14. The modular interconnecting knockdown container system according to claim 13 wherein the coupling tabs are configured to be folded within the container and not extend beyond the end of the container when not utilized to couple the container to an adjacent container.

15. The modular interconnecting knockdown container system according to claim 14 wherein each container is rectangular in cross section and is formed of corrugated cardboard.

16. The modular interconnecting knockdown container system according to claim 15 wherein each container includes a plurality of coupling tabs on each of at least two opposed sides at each end of the container.

17. An individual container of a modular interconnecting knockdown container system, the individual container comprising a knockdown container formed from a single die-cut planar substrate assembled into the container having a plurality of planar sides formed by a plurality of end members and a plurality of side members and extending between opposed end members of the container; wherein each container includes a plurality of coupling tabs adjacent each end of the container and provided on at least two of the sides at each end of the container, wherein each tab is configured to selectively extend beyond an adjacent end of the assembled container, wherein each coupling tab is attached to and extends from one side member, and wherein each coupling tab includes a first fold line between the coupling tab and the side member from which it extends, and includes a first extension extending from the first fold line, and includes a second fold line at an opposed side of the first extension from the first fold line, and includes a second extension extending from the second fold line; and wherein each container includes a plurality of coupling tab receiving slots adjacent each end of the container and provided on at least two of the sides at each end of the container and aligned with the coupling tabs adjacent the end of the container, wherein each tab receiving slot is configured to selectively receive a tab of an adjacent container, wherein each coupling tab received within a tab receiving slot of an adjacent container is configured to be folded about the second fold line, and further including a tab locking slot configured to receive one coupling tab whereby the first extension is adjacent the outside surface of the adjacent container and the second extension is adjacent an opposed interior surface of the adjacent container.

18. The individual container of a modular interconnecting knockdown container system according to claim 17 further including end members configured to selectively form closed ends of the container, and wherein the coupling tabs are configured to be folded within the container and not extend beyond the end of the container when not utilized to couple the container to an adjacent container.

* * * * *